US008330682B2

(12) United States Patent
Nakamura et al.

(10) Patent No.: US 8,330,682 B2
(45) Date of Patent: Dec. 11, 2012

(54) DISPLAY APPARATUS, DISPLAY CONTROL APPARATUS, AND DISPLAY CONTROL METHOD AS WELL AS PROGRAM

(75) Inventors: Kazuo Nakamura, Kanagawa (JP); Katsuhide Uchino, Kanagawa (JP)

(73) Assignee: Sony Corporation, Tokyo (JP)

( * ) Notice: Subject to any disclaimer, the term of this patent is extended or adjusted under 35 U.S.C. 154(b) by 653 days.

(21) Appl. No.: 12/543,558

(22) Filed: Aug. 19, 2009

(65) Prior Publication Data

US 2010/0045709 A1 Feb. 25, 2010

(30) Foreign Application Priority Data

Aug. 20, 2008 (JP) ..... P2008-211719

(51) Int. Cl.
*G09G 3/30* (2006.01)

(52) U.S. Cl. ..... 345/81; 345/76

(58) Field of Classification Search ..... 345/76–83, 345/101, 102, 204–215, 690–699; 315/169.1–169.4
See application file for complete search history.

(56) References Cited

U.S. PATENT DOCUMENTS

| | | | | |
|---|---|---|---|---|
| 7,839,366 | B2 * | 11/2010 | Jung et al. | 345/81 |
| 8,089,476 | B2 * | 1/2012 | Ishiguro et al. | 345/175 |
| 8,199,083 | B2 * | 6/2012 | Fukunaga et al. | 345/84 |
| 2002/0190337 | A1 * | 12/2002 | House et al. | 257/467 |
| 2005/0179625 | A1 * | 8/2005 | Choi et al. | 345/76 |
| 2006/0082523 | A1 * | 4/2006 | Guo et al. | 345/76 |
| 2008/0088545 | A1 * | 4/2008 | Chen et al. | 345/76 |
| 2008/0088549 | A1 * | 4/2008 | Nathan et al. | 345/80 |
| 2009/0225058 | A1 * | 9/2009 | Tateuchi et al. | 345/175 |
| 2009/0258412 | A1 * | 10/2009 | Moriwaki et al. | 435/286.1 |
| 2009/0258413 | A1 * | 10/2009 | Moriwaki et al. | 435/286.1 |
| 2011/0074753 | A1 * | 3/2011 | Yamamoto et al. | 345/207 |

FOREIGN PATENT DOCUMENTS

| | | | |
|---|---|---|---|
| JP | 2000-221908 | | 8/2000 |
| JP | 2000-338518 | | 12/2000 |
| JP | 2002-351403 | | 12/2002 |
| JP | 2004-134472 | A | 4/2004 |
| JP | 2006-201784 | | 8/2006 |
| JP | 2008-145835 | A | 6/2008 |
| JP | 2008-181006 | A | 8/2008 |
| WO | WO2007079572 | | 7/2007 |

OTHER PUBLICATIONS

Japanese Patent Office, Office Action issued in Patent Application JP 2008-211719, on Jun. 24, 2010.
Japanese Patent Office Action corresponding to Japanese Serial No. 2008-211719 dated Apr. 15, 2010.

* cited by examiner

*Primary Examiner* — Alexander Eisen
*Assistant Examiner* — Patrick F Marinelli
(74) *Attorney, Agent, or Firm* — SNR Denton US LLP

(57) ABSTRACT

A display apparatus includes: a plurality of pixel circuits arrayed in a matrix fashion; a light emitting circuit provided to each pixel circuit and emitting light correspondingly to a drive current; and a detection circuit provided to a predetermined pixel circuit and outputting a signal according to a temperature that varies with luminance of the light emitting circuit.

8 Claims, 8 Drawing Sheets

DISPLAY APPARATUS, DISPLAY CONTROL APPARATUS, AND DISPLAY CONTROL METHOD AS WELL AS PROGRAM

BACKGROUND OF THE INVENTION

1. Field of the Invention

The present invention relates to a display apparatus, a display control apparatus, and a display control method as well as a program, and more particularly, to a display apparatus, a display control apparatus, and a display control method as well as a program configured to suppress the occurrence of burn-in.

2. Description of Related Art

Recently, an organic EL (Electro Luminescence) display using organic EL elements receives increasing interest as a type of FPD (Flat Panel Display), and the organic EL display has been under active development.

The current mainstream of FPDs is an LCD (Liquid Crystal Display). The LCD, however, is not a device that uses self-luminescent elements and has to use illumination members, such as a backlight and a polarization plate. The LCD therefore has problems, such as an increase of the device in thickness and insufficient luminance. By contrast, the organic EL display is a device that uses self-luminescence elements. The organic EL luminescence display is therefore advantageous over the LCD in that it can be thinner because a backlight or the like is unnecessary in principle and it can achieve high luminance.

In particular, a so-called active matrix organic EL display provided with a TFT circuit that performs switching in each pixel is able to hold-light ON each pixel and power consumption can be suppressed due to this ability. In addition, because the active matrix organic EL display can be increased in screen size and achieve higher definition with relative ease, active developments have been made and it is expected to become the mainstream of the next-generation FPD.

Incidentally, the characteristic of the organic EL elements varies or deteriorates with the ambient temperature or self-heating. Also, when videos are displayed, the temperature environment of the organic EL elements varies from one video to another. Deterioration conditions of the organic EL elements therefore may differ among portions within the panel. For example, in a case where the organic EL display is used as the display portion of a TV set, when reception channel information (a number indicating the reception channel) is kept displayed on the screen corner, the organic EL elements in the portion where the reception channel information is kept displayed deteriorate faster, and a so-called burn-in phenomenon occurs.

The burn-in phenomenon will now be described, for example, with reference to FIG. 1.

FIG. 1 shows a screen 11A in a state where the reception channel information is displayed and a screen 11B in a state where burn-in occurs.

For example, as is shown in FIG. 1, "12" is displayed on the upper right corner of the screen 11A as the reception channel information. When the reception channel information is kept displayed at the same position for a long time, burn-in occurs because the organic EL elements in this portion deteriorate. As is shown in the screen 11B in a state where burn-in occurs, when a bright video is displayed, burn-in appearing as dark "12" occurs in the portion where the reception channel information has been displayed (within a region encircled by a broken line in FIG. 1).

As a technique of mitigating or preventing such a burn-in phenomenon, for example, JP-A-11-26055 discloses a technique of displaying a video to be kept displayed fixedly by inverting the video at predetermined periods, or a technique of displaying such a video by shifting the video at predetermined periods. In a case where the video is displayed while being inverted at predetermined periods, the technique is effective for a monochrome display. However, for a color display, the inverted video becomes a totally different video. It is therefore difficult to adopt this technique to a color display. In a case where a video is displayed by shifting the video at predetermined periods, the display position is displaced. It is therefore unsuitable to adopt this technique when a still image is displayed.

In addition, for example, JP-A-2002-351403 discloses a method of extending the life by providing dummy pixels outside the display region to detect terminal voltages of the organic EL elements in the dummy pixels when they emits light as a degree of deterioration of the dummy pixels, and correcting a video signal on the basis of the detection result. However, with a correction on the basis of the detection result of the terminal voltages of the dummy pixels, merely the entire display region is corrected from the detection result and the organic EL elements within the display region are not corrected locally. It is therefore difficult to prevent burn-in that occurs locally with this method.

Also, JP-A-2006-201784 discloses a method of correcting a temperature by feeding back an output from a build-in temperature sensor by providing the temperature sensor on the periphery of the panel. However, in a case where the temperature sensor on the periphery of the panel is used, it is possible to detect the overall temperature, but it is quite difficult to accurately detect the temperature distribution within a display region where heat is chiefly generated. It is therefore difficult to prevent burn-in that occurs locally.

SUMMARY OF THE INVENTION

As has been described above, it has been difficult to suppress burn-in that occurs locally with the method of preventing the burn-in phenomenon in the related art.

It is therefore desirable to make it possible to suppress the occurrence of burn-in.

According to an embodiment of the present invention, there is provided a display apparatus including: a plurality of pixel circuits arrayed in a matrix fashion; a light emitting circuit provided to each pixel circuit and emitting light correspondingly to a drive current; and a detection circuit provided to a predetermined pixel circuit and outputting a signal according to a temperature that varies with luminance of the light emitting circuit.

According to another embodiment of the present invention, there is provided a display control apparatus having: display means including a plurality of pixel circuits arrayed in a matrix fashion, a light emitting circuit provided to each pixel circuit and emitting light correspondingly to a drive current, and a detection circuit provided to a predetermined pixel circuit and outputting a signal according to a temperature that varies with luminance of the light emitting circuit; temperature calculation means for calculating the temperature on the basis of the signal outputted from the detection circuit; and correction means for correcting the drive current supplied to the light emitting circuit on the basis of the temperature calculated by the temperature calculation means.

According to another embodiment of the present invention, there is provided a display control method of a display control apparatus that controls a display of a video and includes a plurality of pixel circuits arrayed in a matrix fashion, a light emitting circuit provided to each pixel circuit and emitting light correspondingly to a drive current, and a detection circuit provided to a predetermined pixel circuit and outputting a signal according to a temperature that varies with luminance of the light emitting circuit, including the steps of: calculating the temperature on the basis of the signal outputted from the detection circuit; and correcting the drive current supplied to the light emitting circuit on the basis of the calculated temperature.

According to another embodiment of the present invention, there is provided a program causing a computer to function as a display control apparatus that controls a display of a video and includes a plurality of pixel circuits arrayed in a matrix fashion, a light emitting circuit provided to each pixel circuit and emitting light correspondingly to a drive current, and a detection circuit provided to a predetermined pixel circuit and outputting a signal according to a temperature that varies with luminance of the light emitting circuit, and the program causes the computer to function as follows: temperature calculation means for calculating the temperature on the basis of the signal outputted from the detection circuit; and correction means for correcting the drive current supplied to the light emitting circuit on the basis of the temperature calculated by the temperature calculation means.

According to the embodiment of the present invention, the light emitting circuit provided to each of a plurality of pixel circuits arrayed in a matrix fashion emits light correspondingly to a drive current. The detection circuit provided to a predetermined pixel circuit outputs a signal according to a temperature that varies with luminance of the light emitting circuit.

According to the embodiment of the present invention, the display control apparatus includes a plurality of pixel circuits arrayed in a matrix fashion, a light emitting circuit provided to each pixel circuit and emitting light correspondingly to a drive current, and a detection circuit provided to a predetermined pixel circuit and outputting a signal according to a temperature that varies with luminance of the light emitting circuit. The temperature is calculated on the basis of the signal outputted from the detection circuit and the drive current supplied to the light emitting circuit is corrected on the basis of the calculated temperature.

According to the embodiments of the present invention, it is possible to suppress the occurrence of burn-in.

DESCRIPTION OF THE PREFERRED EMBODIMENTS

Hereinafter, a concrete embodiment of the present invention will be described in detail with reference to the drawings.

Figure 2:
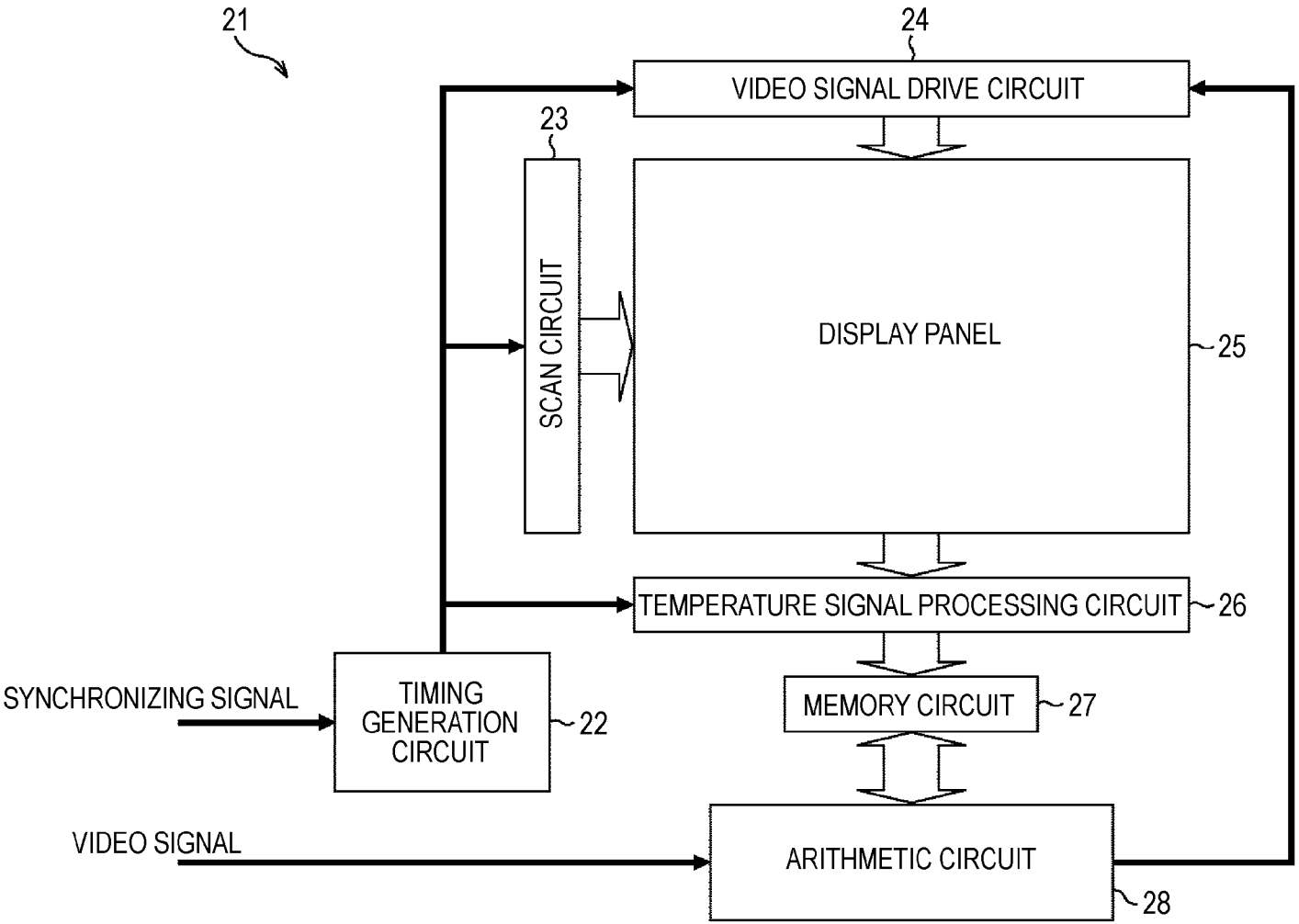
FIG. 2 is a block diagram showing an example of the configuration of a display apparatus according to an embodiment of the present invention.

FIG. 2 is a block diagram showing an example of the configuration of a display apparatus according to an embodiment of the present invention.

Referring to FIG. 2, a display apparatus 21 includes a timing generation circuit 22, a scan circuit 23, a video signal drive circuit 24, a display panel 25, a temperature signal processing circuit 26, a memory circuit 27, and an arithmetic circuit 28.

A synchronization signal at a predetermined frequency specifying the break of a video signal is supplied to the timing generation circuit 22 from an unillustrated circuit in the preceding stage. According to this synchronizing signal, the timing generation circuit 22 generates timing signals each determining the timing of processing in the scan circuit 23, the video signal drive circuit 24, and the temperature signal processing circuit 26 and supplies the timing signals to the scan circuit 23, the video signal drive circuit 24, and the temperature signal processing circuit 26.

The scan circuit 23 performs the control to scan pixels, which are provided to the display panel 25 in a matrix fashion, line by line according to the timing signal (for example, a vertical synchronizing signal) supplied from the timing generation circuit 22.

The video signal drive circuit 24 drives the respective pixels of the display panel 25 on the basis of a video signal supplied via the arithmetic circuit 28 according to the timing signal (for example, a horizontal synchronizing signal) supplied from the timing generation circuit 22.

The display panel 25 has pixels formed of organic EL elements and provided in a matrix fashion and displays a video according to signals supplied from the scan circuit 23 and the video signal drive circuit 24. Also, as will be described below with reference to FIG. 3, each of the pixels of the display panel 25 is provided with a temperature detection circuit. The display panel 25 supplies a signal outputted from the temperature detection circuit of each pixel (for example, a signal indicating potential at a node A of FIG. 3 described below) to the temperature signal processing circuit 26.

As will be described below with reference to FIG. 6, a preliminarily found equation that linearly approximates measurement values of the absolute temperature T and an anode potential difference $\Delta V$ is set in the temperature signal processing circuit 26. Signals from the temperature detection circuits of the respective pixels of the display panel 25 are supplied to the temperature signal processing circuit 26. The temperature signal processing circuit 26 finds the anode potential difference $\Delta V$ from these signals and calculates the absolute temperature T of each pixel from the anode potential difference $\Delta V$. The temperature signal processing circuit 26 then converts the absolute temperature T of each pixel from the analog form to the digital form and makes the memory circuit 27 store the resulting temperature data on a pixel-by-pixel basis.

The memory circuit 27 stores the temperature data supplied from the temperature signal processing circuit 26 on a pixel-by-pixel basis. For example, the memory circuit 27 is able to store temperature data for one frame of a video signal. Besides the temperature data, the memory circuit 27 stores data necessary for the processing by the arithmetic circuit 28, for example, one frame of a video signal and correction coefficients used to correct the video signal.

A video signal is supplied to the arithmetic circuit 28 from an unillustrated circuit in the preceding stage. The arithmetic circuit 28 supplies one frame of a video signal to the memory circuit 27 so that the video signal is temporarily stored therein. Also, upon supply of one frame of a video signal, the arithmetic circuit 28 reads out the video signal of the last frame immediately preceding the current frame and the temperature data found when the video on the basis of the video signal of the last frame was displayed on the display panel 25, both of which are stored in the memory circuit 27. The arithmetic circuit 28 then finds the correction coefficient used to correct the video signal level of the current frame on a pixel-by-pixel basis and makes the memory circuit 27 temporarily store the correction coefficients.

For example, in a case where the video signal level (luminance value) of the last frame is large and the temperature data when the video on the basis of the video signal of the last frame was displayed indicates a high temperature, the arithmetic circuit 28 finds a correction coefficient such that lowers the video signal level of the current frame on a pixel-by-pixel basis. For example, the arithmetic circuit 28 has a table of correction coefficients in which the video signal level and the temperature data are correlated with each other, and it finds the correction coefficient by referring to the table.

The arithmetic circuit 28 then corrects the video signal level of the current frame by multiplying the video signal level of the current frame by the correction coefficient stored in the memory circuit 27 on a pixel-by-pixel basis, and supplies the corrected video signal to the video signal drive circuit 24.

As has been described, in the display apparatus 21, the video signal is corrected on the basis of temperature data of the pixels forming the display panel 25 found on a pixel-by-pixel basis and a video on the basis of the corrected video signal is displayed on the display panel 25.

Figure 3:
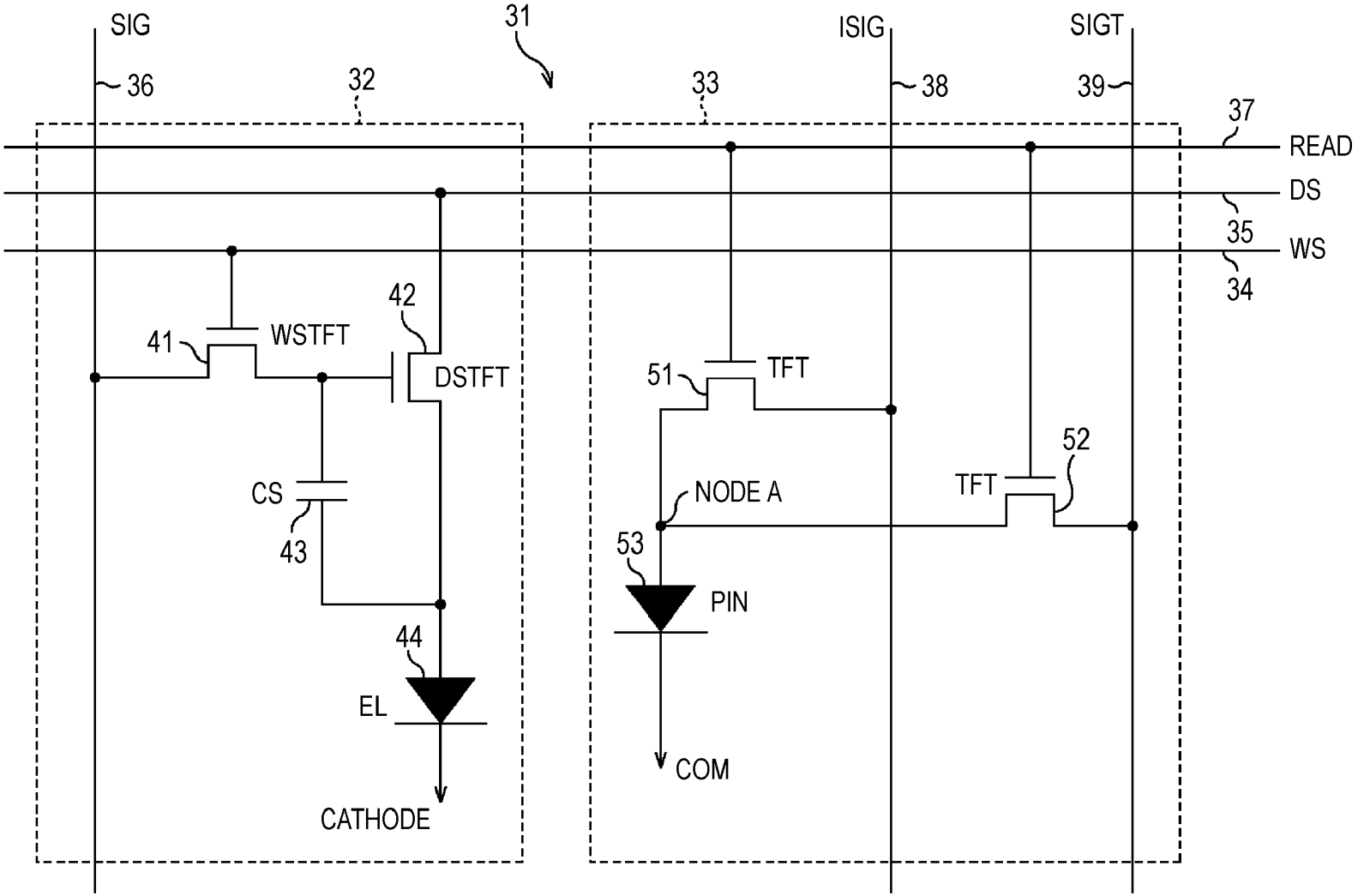
FIG. 3 is a circuit diagram of a pixel circuit corresponding to one pixel forming a display panel.

FIG. 3 is a circuit diagram of a pixel circuit corresponding to one pixel forming the display panel 25.

Referring to FIG. 3, a pixel circuit 31 includes a light emitting circuit 32 and a temperature detection circuit 33.

The light emitting circuit 32 of the pixel circuit 31 is connected to the scan circuit 23 of FIG. 2 via a scan line (WS) 34 and a power supply line (DS) 35 and connected to the video signal drive circuit 24 of FIG. 2 via a pixel signal line (SIG) 36. Also, the temperature detection circuit 33 of the pixel circuit 31 is connected to the scan circuit 23 via a read line (READ) 37 and connected to the temperature signal processing circuit 26 of FIG. 2 via a current signal line (ISIG) 38 and a temperature detection signal line (SIGT) 39.

The light emitting circuit 32 has a write transistor (WSTFT) 41, a drive transistor (DSTFT) 42, a storage capacitor (CS) 43, and an organic EL element 44.

The gate of the write transistor 41 is connected to the scan line 34 and the drain of the write transistor 41 is connected to the pixel signal line 36. The source of the write transistor 41 is connected to the gate of the drive transistor 42, and one end of the storage capacitor 43 is connected to this connection point.

The drain of the drive transistor 42 is connected to the power supply line 35 and the source of the drive transistor 42 is connected to the anode of the organic EL element 44. Also, the other end of the storage capacitor 43 is connected to this connection point. Also, the cathode of the organic EL element 44 is connected to predetermined cathode potential (CATHODE).

In the light emitting circuit 32 configured as above, charges according to the pixel signal supplied via the pixel signal line 36 are accumulated and held in the storage capacitor 43 at the timing of the control signal supplied via the scan line 34, and a current corresponding to the charges flows to the organic EL element 44. The organic EL element 44 thus emits light at luminance corresponding to the pixel signal. The temperature of the organic EL element 44 varies with the luminance thereof.

The temperature detection circuit 33 includes transistors (TFTs) 51 and 52 and a PIN diode (p-intrinsic-n Diode) 53.

The gate of the transistor 51 is connected to the read line 37, the drain of the transistor 51 is connected to the current signal line 38, and the source of the transistor 51 is connected to the anode of the PIN diode 53. Hereinafter, this connection point is referred to as the node A where appropriate and the drain of the transistor 52 is connected to the node A. Also, the gate of the transistor 52 is connected to the read line 37 and the source of the transistor 52 is connected to the temperature detection signal line 39. The cathode of the PIN diode 53 is connected, for example, to predetermined reference potential (COM).

In the temperature detection circuit 33 configured as above, each time the display panel 25 displays one frame of a video, that is, each time the organic EL element 44 emits light according to the pixel signal in the light emitting circuit 32, processing to read out potential at the node A twice from the temperature detection circuit 33 is performed.

More specifically, timing of an operation to read out the voltage at the node A in the temperature detection circuit 33 will be described with reference to FIG. 4.

Figure 4:
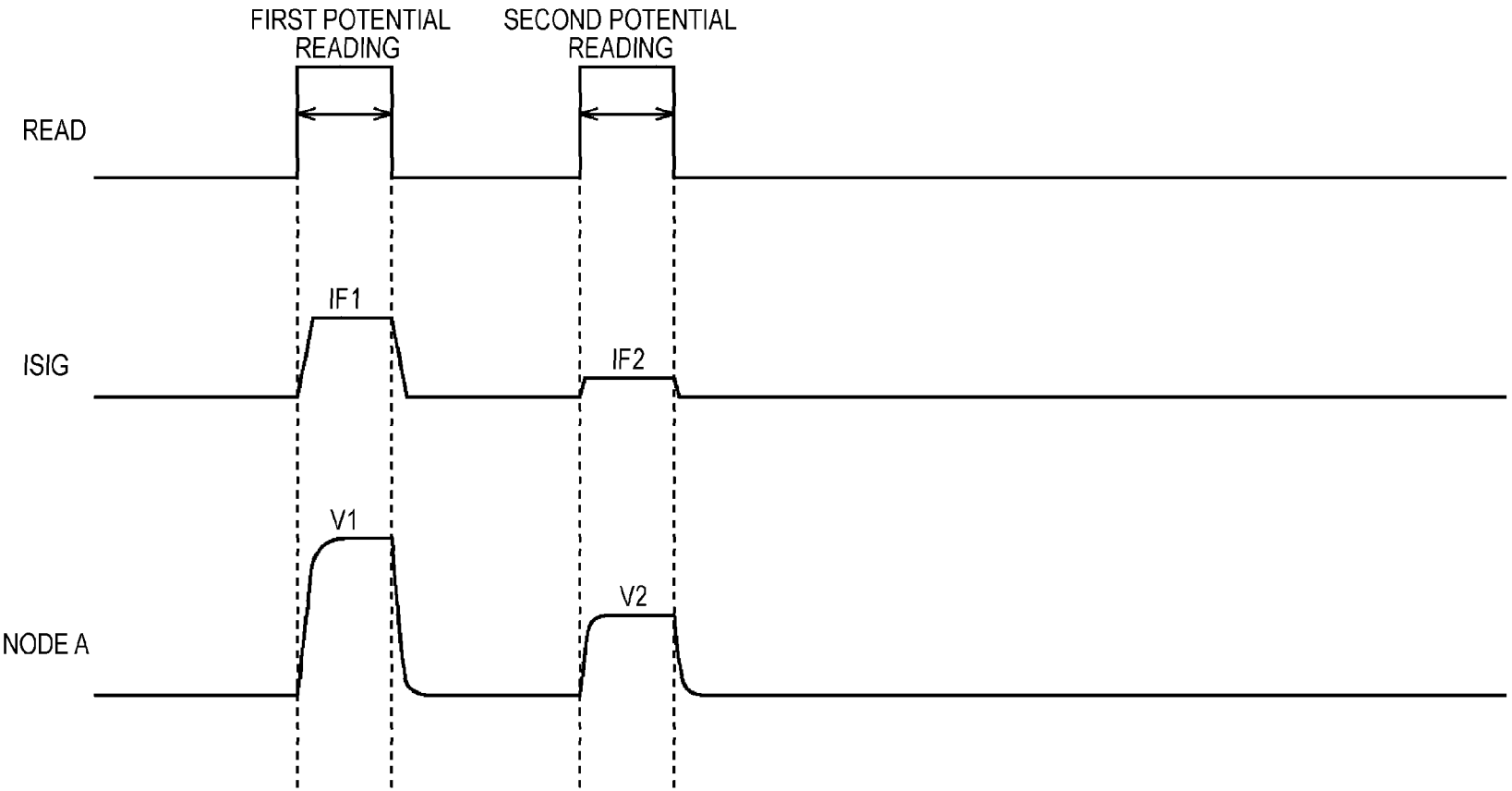
FIG. 4 is a view used to describe the timing of an operation to read out the voltage at a node of a temperature detection circuit.

FIG. 4 shows potential of a read signal supplied to the transistors 51 and 52 via the read line 37, a current value of the current flowing to the PIN diode 53 via the current signal line 38, and potential at the node A.

Initially, a current value IF1 is outputted to the current signal line 38 from the temperature signal processing circuit 26. The transistors 51 and 52 come ON as the potential of the read signal is switched from low potential to high potential at the timing at which reading of the potential at the node A for the first time is started. As the transistor 51 comes ON, a constant current at the current value IF1 is supplied to the PIN diode 53 via the current signal line 38. The potential at the node A thus becomes V1. At the same time, as the transistor 51 comes ON, the potential V1 at the node A is outputted to the temperature detection signal line 39. The potential of the read signal is then switched from high potential to low potential.

After an elapse of a predetermined time since the current outputted to the current signal line 38 from the temperature signal processing circuit 26 dropped from the current value IF1 to a current value IF2, the potential of the read signal is switched from low potential to high potential at the timing at which reading of the potential at the node A for the second time is started. The transistors 51 and 52 thus come ON and a constant current at the current value IF2 is supplied to the PIN diode 53. Accordingly, the potential at the node A becomes V2 and the potential V2 at the node A is outputted via the temperature detection signal line 39. The potential of the read signal is then switched from high potential to low potential.

As has been described, the temperature detection circuit 33 outputs to the temperature signal processing circuit 26 both the anode potential V1 of the PIN diode 53 when a constant current at the current value IF1 flows to the PIN diode 53 and the anode potential V2 of the PIN diode 53 when a constant current at the current value IF2 flows to the PIN diode 53. The temperature signal processing circuit 26 then calculates the absolute temperature from a potential difference between the anode potential V1 and the anode potential V2 on the basis of the temperature characteristic of the PIN diode 53.

The temperature characteristic of the PIN diode 53 when driven by forward bias will now be described with reference to FIG. 5.

Figure 5:
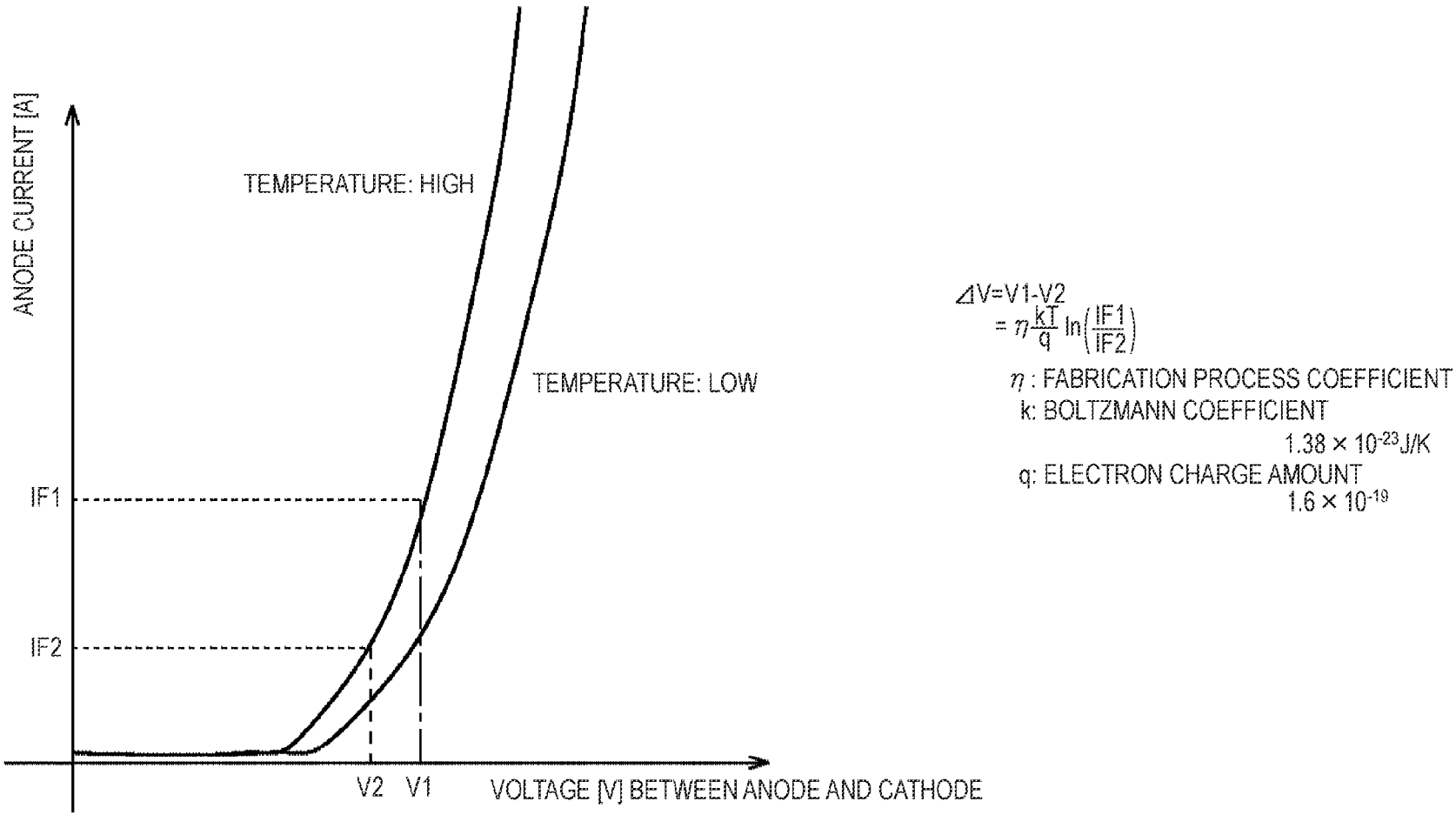
FIG. 5 is a view used to describe the temperature characteristic of a PIN diode when driven by forward bias.

In FIG. 5, the abscissa is used for a voltage between the anode and the cathode of the PIN diode 53 and the ordinate is used for the forward current flowing in the forward direction from the anode of the PIN diode 53. It should be noted that the temperature detection circuit 33 of FIG. 3 outputs the anode potential of the PIN diode 53 with respect to the predetermined reference potential but the anode potential with respect to the cathode potential of the PIN diode 53, that is, the voltage between the anode and the cathode, will be described with reference to FIG. 5.

For example, the temperature dependency of the anode potential difference ΔV between the voltage V1 when the forward current IF1 is flown in the forward direction from the anode of the PIN diode 53 and the voltage V2 when the forward current IF2 (IF1>IF2) is flown is expressed as Equation (1).

$$\Delta V = \eta \frac{k \cdot T}{q} \ln\left(\frac{IF1}{IF2}\right) \tag{1}$$

In Equation (1) above, η is a coefficient in the fabrication process, k is a Boltzmann coefficient, T is the absolute temperature, and q is a charge amount of one electron.

Hence, by obtaining the anode potential difference ΔV (V1−V2) and the forward currents IF1 and IF2, the temperature signal processing circuit 26 of FIG. 2 becomes able to find the absolute temperature T of the PIN diode 53 by calculating Equation (1) above.

Figure 6:
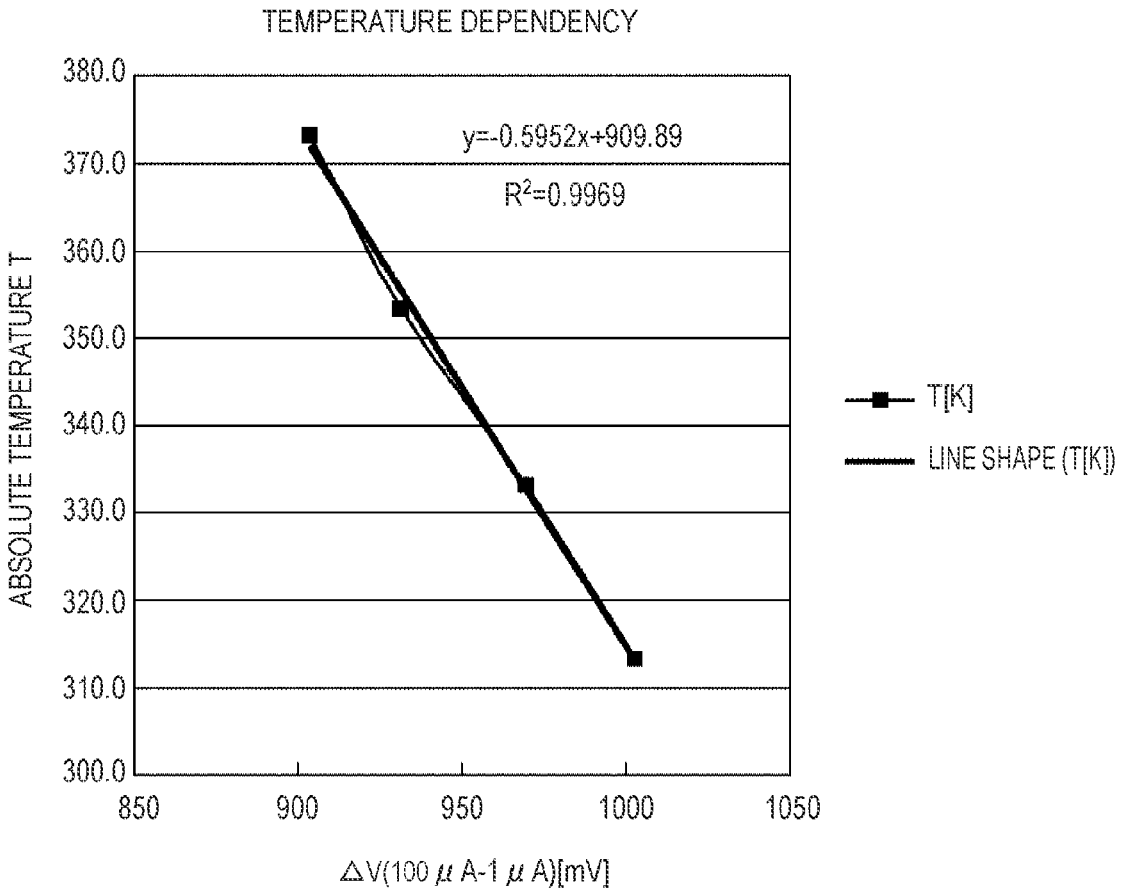
FIG. 6 is a view used to describe the temperature dependency characteristic of the PIN diode.

FIG. 6 is a view showing the temperature dependency characteristic of the PIN diode 53.

In FIG. 6, the abscissa is used for the anode potential difference ΔV and the ordinate is used for the absolute temperature T. FIG. 6 shows the anode potential difference ΔV measured when 100 μA and 1 μA were flown as the forward currents IF1 and IF2, respectively, and the absolute temperature T measured in this instance.

As is shown in FIG. 6, the anode potential difference ΔV varies linearly with respect to the absolute temperature T and an equation shown in FIG. 6 is found through linear approximation. For example, the linear approximation equation found in this manner can be set in the temperature signal processing circuit 26 of FIG. 2. Accordingly, the signal processing circuit 26 reads out the anode potentials V1 and V2 when the forward currents IF1 and IF2 were respectively flown to the PIN diode 53 to find the temperature of each pixel by calculating the anode potential difference ΔV, and makes the memory circuit 27 store the temperature data.

As has been described, in the display apparatus 21, by providing the temperature detection circuit 33 to each pixel circuit 31, it becomes possible to detect the temperature of each pixel. The arithmetic circuit 28 reads out the temperature data thus stored in the memory circuit 27 to find the correction coefficient and corrects the video signal.

Figure 7:
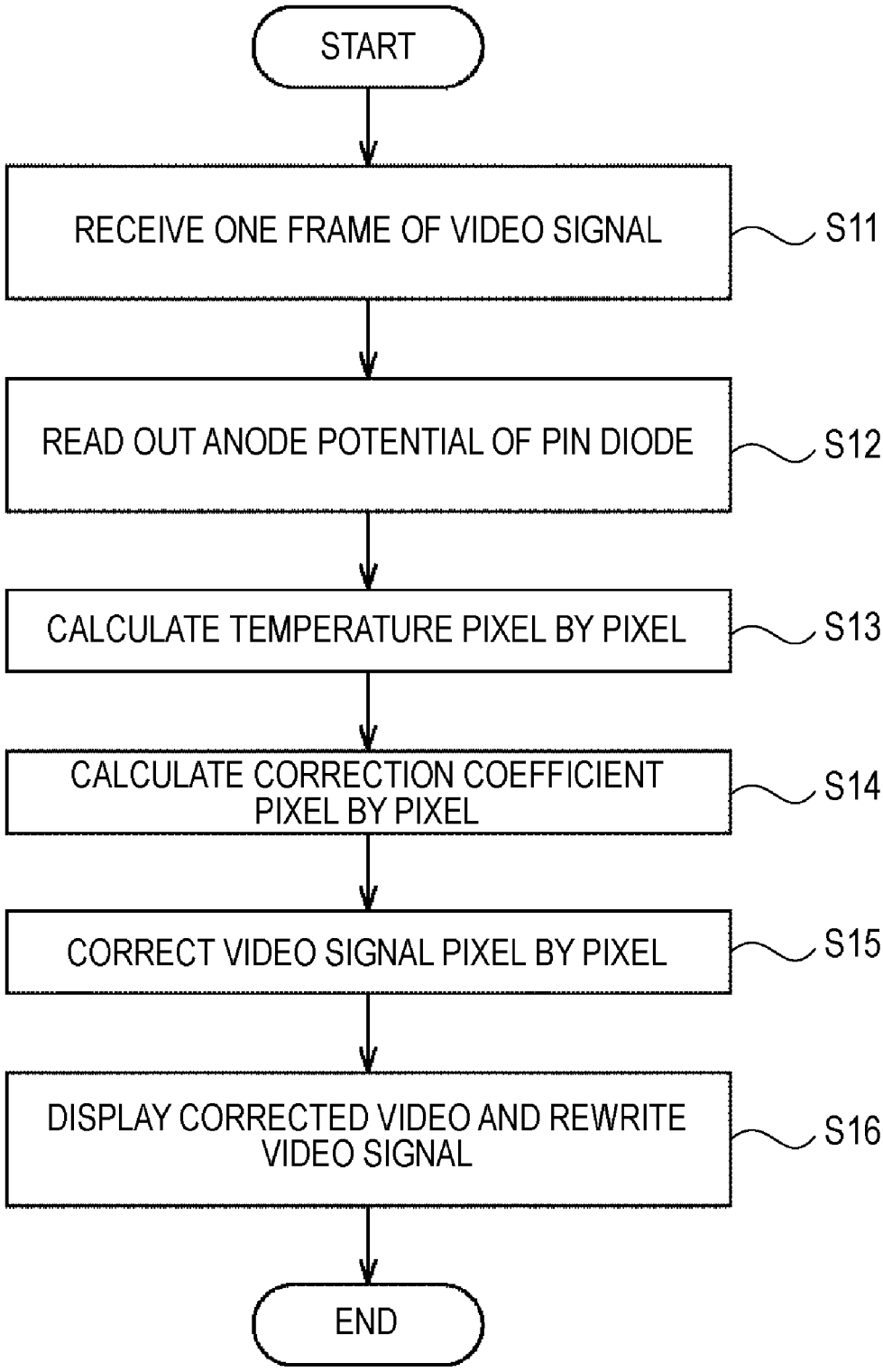
FIG. 7 is a flowchart used to describe the processing by the display apparatus to find a correction coefficient on the basis of temperature data on a pixel-by-pixel basis, correct an image, and display the corrected image.

FIG. 7 is a flowchart used to describe the processing by the display apparatus 21 of FIG. 2 to find the correction coefficient on the basis of the temperature data on a pixel-by-pixel basis, correct a video, and display the corrected video. For example, this processing is performed each time one frame of a video signal is supplied to the arithmetic circuit 28 from the circuit in the preceding stage. While the processing is performed on one certain frame, the video signal of the last frame immediately preceding this frame is stored in the memory circuit 27.

In Step S11, the arithmetic circuit 28 receives one frame of a video signal supplied from the circuit in the preceding circuit and the flow proceeds to the processing in Step S12.

In Step S12, the temperature signal processing circuit 26 reads out the potentials V1 and V2 at the node A from the temperature detection circuit 33 for each pixel circuit 31 of FIG. 3, and the flow proceeds to the processing in Step S13. Herein, the potentials V1 and V2 at the node A when the video of the last frame was displayed are read out from the temperature detection circuit 33.

In Step S13, the temperature signal processing circuit 26 calculates the absolute temperature T of the PIN diode 53 from the potentials V1 and V2 at the node A on the basis of the temperature characteristic of the PIN diode 53. The temperature signal processing circuit 26 converts the absolute temperature T, which is found on a pixel-by-pixel basis, that is, for each pixel circuit 31, from the analog form to the digital form and makes the memory circuit 27 store the resulting temperature data.

After the processing in Step S13, the flow proceeds to the processing in Step S14, where the arithmetic circuit 28 reads out the video signal of the last frame stored in the memory circuit 27 and the temperature data of each pixel stored in Step S13 from the memory circuit 27. The arithmetic circuit 28 then finds the correction coefficient on a pixel-by-pixel basis on the basis of the video signal and the temperature data and makes the memory circuit 27 store the correction coefficients. The flow then proceeds to the processing in Step S15.

In Step S15, the arithmetic circuit 28 reads out the correction coefficient stored in the memory circuit 27 in Step S14 on a pixel-by-pixel basis and corrects the video signal on a pixel-by-pixel basis by multiplying the correction coefficient by the pixel value corresponding to the pixel of interest and contained in the video signal received in Step S11.

After the processing in Step S15, the flow proceeds to the processing in Step S16, where the arithmetic circuit 28 supplies the corrected video signal to the video signal drive circuit 24 to make the display panel 25 display the video. Also, the arithmetic circuit 28 rewrites (updates) the video signal of the last frame stored in the memory circuit 27 with the current video signal and the processing terminates.

As has been described, in the display apparatus 21, the temperature signal processing circuit 26 calculates the temperature of each pixel of the display panel 25 and the arithmetic circuit 28 finds the correction coefficient used to correct the video signal on the basis of the calculated temperature and corrects the video signal. Hence, for example, when the temperature of a given pixel is high, it becomes possible to make a correction in such manner that the luminance value of the video signal corresponding to this pixel is reduced, that is, to correct the video signal on a pixel-by-pixel basis. By correcting the video signal through the temperature feedback as described above, that is, by correcting a current to be supplied to the organic EL element 44 in the light emitting circuit 32, it becomes possible to avoid an event that the temperature of the display panel 25 rises locally, which can consequently suppress the occurrence of burn-in. It thus becomes possible to avoid deterioration of the image quality caused by burn-in. Accordingly, the life of the display panel 25 can be prolonged.

Figure 1:
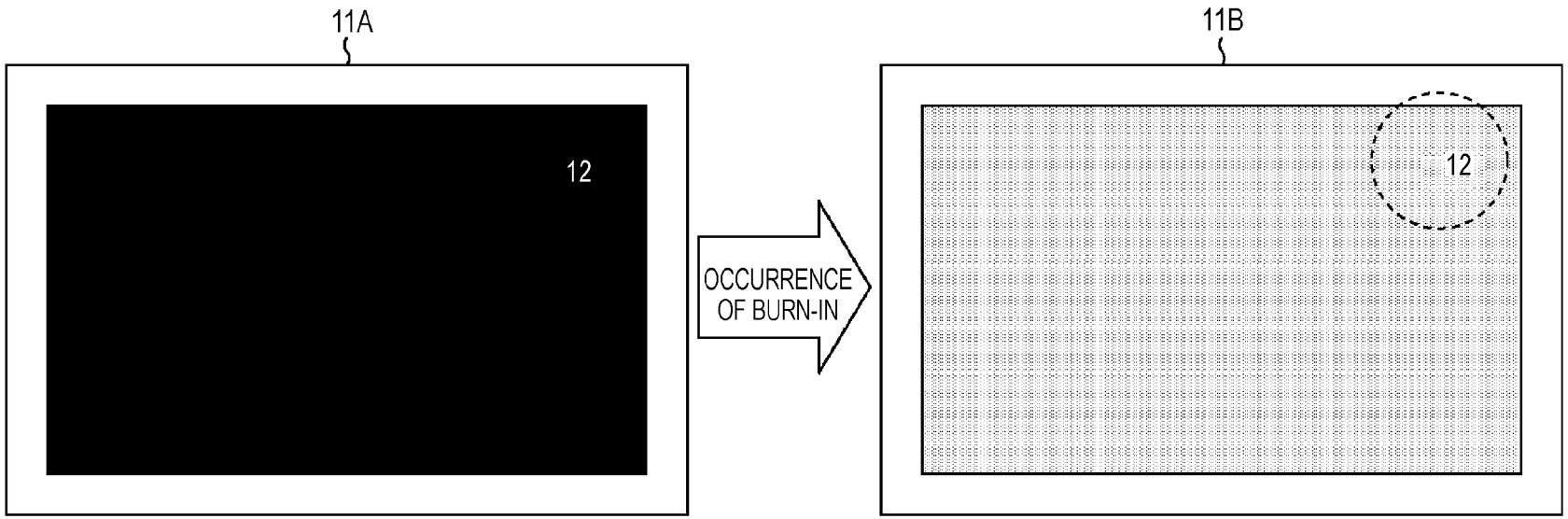
FIG. 1 is a view used to describe a burn-in phenomenon.

In particular, as has been described with reference to FIG. 1, when the reception channel information or the like is kept displayed, it is thought that burn-in occurs because the organic EL elements deteriorate with the rising of the temperature in the corresponding portion. To eliminate this problem, the display apparatus 21 is able to adjust the luminance of the portion where the reception channel information is displayed on a pixel-by-pixel basis in response to the temperature. It thus becomes possible to suppress local deterioration of the organic EL elements.

In the pixel circuit 31, by forming the temperature detection circuit 33 from the PIN diode 53, the temperature detection circuit 33 can be fabricated in the process of fabricating the light emitting circuit 32. It thus becomes possible to fabricate the temperature detection circuit 33 with east at a low cost without any change from the process in the related art.

Also, as is shown in FIG. 3, by providing the PIN diode 53 at the position in the vicinity of the light emitting circuit 32, in particular, in the vicinity of the organic EL element 44 in the temperature detection circuit 33, it becomes possible to detect a variance in temperature of the light emitting circuit 32 more accurately by the PIN diode 53.

Also, because the temperature detection circuit 33 detects the anode potential of the PIN diode 53, it can be achieved by a simple circuit configuration formed of two transistors 51 and 52.

Besides finding the pixel temperature from the anode potential of the PIN diode 53, the temperature signal processing circuit 26 may find, for example, the temperature of the pixel from the voltage between the anode and the cathode of the PIN diode 53. In this case, a transistor to read out the potential at the cathode of the PIN diode 53 is provided in the pixel circuit 31.

Figure 8:
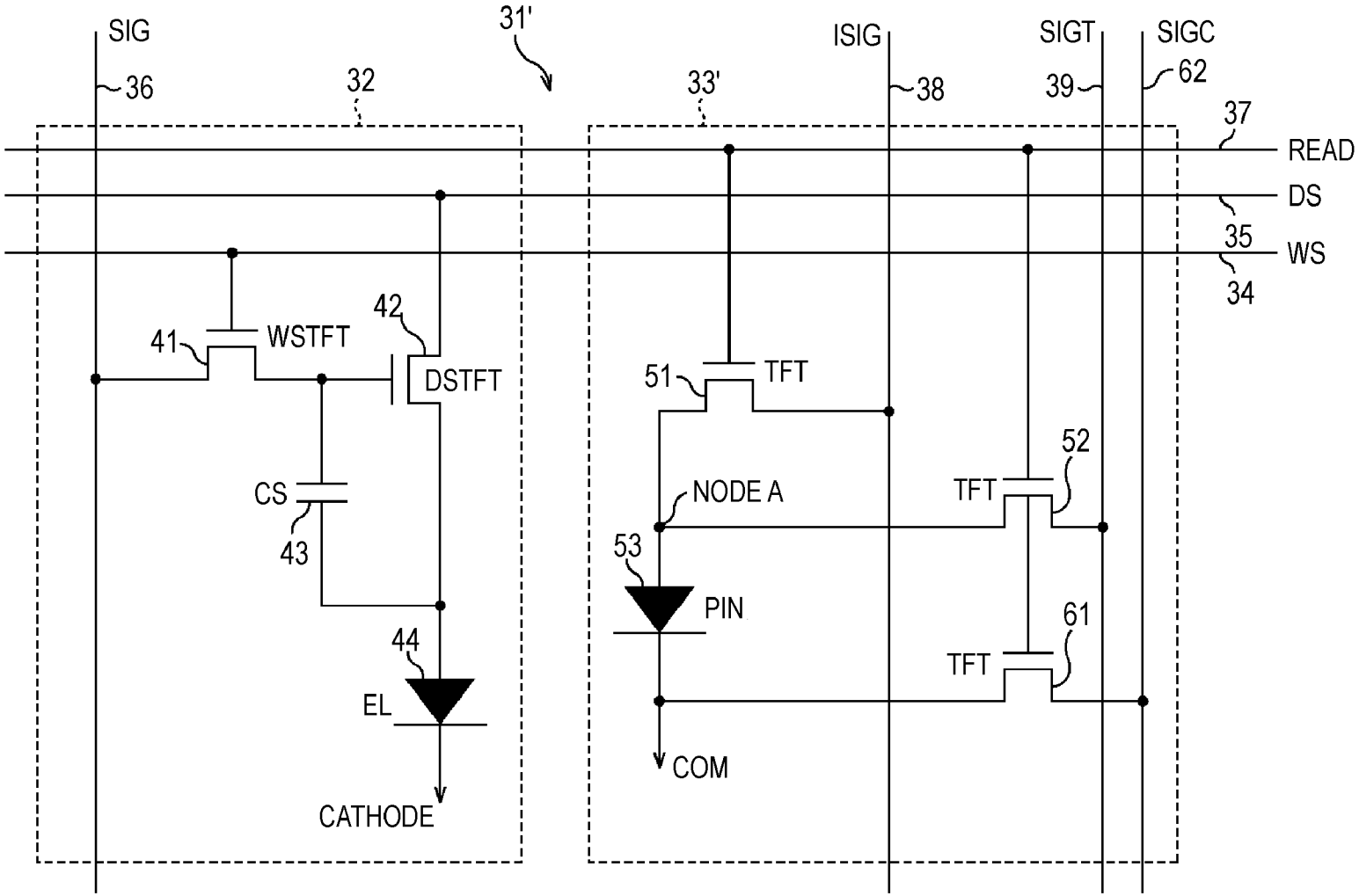
FIG. 8 is a circuit diagram of the pixel circuit according to an embodiment of the present invention.

More specifically, FIG. 8 shows the circuit diagram of the pixel circuit in such a case according to an embodiment of the present invention.

In the drawing, like members are labeled with like reference numerals with respect to FIG. 3 and descriptions of such members are omitted in the following where appropriate.

To be more specific, referring to FIG. 8, the light emitting circuit 32 is common with the counterpart of FIG. 3 in that it includes the write transistor 41, the drive transistor 42, the storage capacitor 43, and the organic EL element 44 and the temperature detection circuit 33 is common with the counterpart of FIG. 3 in that it includes the transistors 51 and 52 and the PIN diode 53. The both circuits are also common with the respective counterparts of FIG. 3 in that they are connected to the scan circuit 23 via the scan line 34, the power supply line 35, and the read line 37, connected to the video signal drive circuit 24 via the pixel signal line 36, and connected to the temperature signal processing circuit 26 via the current signal line 38 and the temperature detection signal line 39.

A temperature detection circuit 33' of FIG. 8 is different from the counterpart of FIG. 3 in that a transistor 61 is newly provided and it is connected to the temperature signal processing circuit 26 via a temperature detection signal line (SIGC) 62.

In the temperature detection circuit 33' of a pixel circuit 31' of FIG. 8, the gate of the transistor 61 is connected to the read line 37, the drain of the transistor 61 is connected to the cathode of the PIN diode 53, and the source of the transistor 61 is connected to the temperature detection signal 62. The transistor 61 comes ON simultaneously with the transistor 52 and supplies the cathode potential of the PIN diode 53 to the temperature signal processing circuit 26 via the temperature detection signal line 62.

The anode potential of the PIN diode 53 is supplied to the temperature signal processing circuit 26 via the temperature detection signal 39 and the cathode potential of the PIN diode 53 is also supplied to the temperature signal processing circuit 26 via the temperature detection signal line 62. The temperature signal processing circuit 26 then calculates the temperature of the PIN diode 53 on the basis of the voltage between the anode and the cathode of the PIN diode 53.

As has been described, by calculating the temperature using the voltage between the anode and the cathode of the PIN diode 53, it becomes possible to calculate the temperature of the PIN diode 53 more accurately than in a case where the anode potential is used.

In this embodiment, the temperature detection circuit 33 detects the temperature each time the light emitting circuit 32 emits light according to one frame of a video signal. The light emitting circuit 32 and the temperature detection circuit 33, however, may be controlled independently. More specifically, for example, it may be configured in such a manner that the temperature detection circuit 33 detects the temperature once while the light emitting circuit 32 emits a predetermined number of rays of light according to a predetermined number of frames. By extending the interval at which the temperature is detected by the temperature detection circuit 33 in this manner, a burden of the processing on the arithmetic circuit 28 can be lessened.

Also, in this embodiment, the temperature detection circuit 33 is provided to each pixel circuit 31 of the display panel 25. However, it may be configured in such a manner that the pixel circuit 31 is provided to each pixel made of RGB or the display panel 25 is divided into a plurality of regions to provide the pixel circuit 31 to each region. By reducing the number of the temperature detection circuits 33 in this manner, the number of items of temperature data to be detected can be reduced, which makes it possible to make the memory circuit 27 smaller and to accelerate the processing.

Alternatively, it may be configured in such a manner that the temperature detection circuit 33 is provided to all the pixel circuits 31, so that the temperature data is detected from each predetermined number of pixel circuits 31 by adjusting the temperature detection circuits 33 to be sampled.

Also, as is shown in FIG. 3, the light emitting circuit 32 adopts a 2Tr (transistor)+1C (capacitor) circuit. The light emitting circuit 32, however, can adopt any type of circuit.

Each processing described with reference to the flowchart above is not necessarily carried out time sequentially in order of description of the flowchart, and it includes processing to be carried out in parallel or separately (for example, the parallel processing or processing by an object). Also, the program for the arithmetic circuit 28 to perform the processing includes programs other than a program pre-stored in the arithmetic circuit 28. For example, a program may be newly stored (the program may be updated) in the arithmetic circuit 28 via an unillustrated communication portion.

It should be appreciated that the present invention is not limited to the embodiments described above and can be modified in various manners without deviating from the scope of the invention.

The present application contains subject matter related to that disclosed in Japanese Priority Patent Application JP 2008-211719 filed in the Japan Patent Office on Aug. 20, 2008, the entire contents of which is hereby incorporated by reference.

What is claimed is:

1. A display apparatus comprising:

a plurality of pixel circuits arrayed in a matrix fashion;

a light emitting circuit provided for each pixel circuit and configured to emit light according to a drive current; and a detection circuit provided for a predetermined pixel circuit and configured to output a signal according to a temperature that varies with luminance of the light emitting circuit, wherein, the detection circuit includes a PIN (p-intrinsic-n) diode and at least two switches, and one terminal of each switch is directly connected to an anode of the PIN diode, and wherein the detection circuit, when a constant current is flown between the anode and a cathode of the PIN diode by driving the PIN diode by forward bias, outputs potential at the anode as the signal.

2. The display apparatus according to claim 1, wherein the detection circuit, when a constant current is flown between the anode and a cathode of the PIN diode by driving the PIN diode by forward bias, outputs a potential difference between potential at the anode and potential at the cathode as the signal.

3. The display apparatus according to claim 1 or 2, wherein the at least two switches are used to control a current supplied to the PIN diode.

4. The display apparatus according to claim 1 or 2, wherein the PIN diode of the detection circuit is at a position adjacent to the light emitting circuit.

5. A display control apparatus comprising:

display means including (a) a plurality of pixel circuits arrayed in a matrix, (b) a light emitting circuit provided for each pixel circuit and configured to emit light according to a drive current, and (c) a detection circuit provided for a predetermined pixel circuit and configured to output a signal according to a temperature that varies with luminance of the light emitting circuit;

temperature calculation means for calculating the temperature on the basis of the signal outputted from the detection circuit; and correction means for correcting the drive current supplied to the light emitting circuit on the basis of the temperature calculated by the temperature calculation means, wherein, the detection circuit includes a PIN (p-intrinsic-n) diode and at least two switches, and one terminal of each switch is directly connected to an anode of the PIN diode, and wherein the detection circuit, when a constant current is flown between the anode and a cathode of the PIN diode by driving the PIN diode by forward bias, outputs potential at the anode as the signal.

6. A display control method of a display control apparatus that controls a display of a video and includes display means including (a) a plurality of pixel circuits arrayed in a matrix, (b) a light emitting circuit provided for each pixel circuit and configured to emit light according to a drive current, and (c) a detection circuit provided for a predetermined pixel circuit and configured to output a signal according to a temperature that varies with luminance of the light emitting circuit, comprising the steps of:

calculating the temperature on the basis of the signal outputted from the detection circuit; and correcting the drive current supplied to the light emitting circuit on the basis of the calculated temperature, wherein, the detection circuit includes a PIN (p-intrinsic-n) diode and at least two switches, and one terminal of each switch is directly connected to an anode of the PIN diode, and wherein the detection circuit, when a constant current is flown between the anode and a cathode of the PIN diode by driving the PIN diode by forward bias, outputs potential at the anode as the signal.

7. A non-transitory computer-readable medium having instructions recorded thereon, wherein the instructions, when read by a computer, cause the computer to function as a display control apparatus that controls a display of a video and includes (a) a plurality of pixel circuits arrayed in a matrix, (b) a light emitting circuit provided for each pixel circuit and configured to emit light according to a drive current, and (c) a detection circuit provided for a predetermined pixel circuit and configured to output a signal according to a temperature that varies with luminance of the light emitting circuit, wherein the instructions cause the computer to function as follows:

calculating the temperature on the basis of the signal outputted from the detection circuit; and correction means for correcting the drive current supplied to the light emitting circuit on the basis of the temperature calculated by the temperature calculation means, wherein, the detection circuit includes a PIN (p-intrinsic-n) diode and at least two switches, and one terminal of each switch is directly connected to an anode of the PIN diode, and wherein the detection circuit, when a constant current is flown between the anode and a cathode of the PIN diode by driving the PIN diode by forward bias, outputs potential at the anode as the signal.

8. A display control apparatus comprising:

a display unit including (a) a plurality of pixel circuits arrayed in a matrix, (b) a light emitting circuit provided for each pixel circuit and configured to emit light according to a drive current, and (c) a detection circuit provided for a predetermined pixel circuit and configured to output a signal according to a temperature that varies with luminance of the light emitting circuit;

a temperature calculation unit configured to calculate the temperature on the basis of the signal outputted from the detection circuit; and a correction unit configured to correct the drive current supplied to the light emitting circuit on the basis of the temperature calculated by the temperature calculation unit, wherein, the detection circuit includes a PIN (p-intrinsic-n) diode and at least two switches, and one terminal of each switch is directly connected to an anode of the PIN diode, and wherein the detection circuit, when a constant current is flown between the anode and a cathode of the PIN diode by driving the PIN diode by forward bias, outputs potential at the anode as the signal.

* * * * *